US007870752B2

(12) United States Patent
Nejad

(10) Patent No.: US 7,870,752 B2
(45) Date of Patent: Jan. 18, 2011

(54) HEAT EXTRACTION MACHINE AND A METHOD OF OPERATING A HEAT EXTRACTION MACHINE

(75) Inventor: Ali R. Nejad, Schorndorf-Weiler (DE)

(73) Assignee: Emerson Electric GmbH & Co. OHG, Walblingen (DE)

( * ) Notice: Subject to any disclaimer, the term of this patent is extended or adjusted under 35 U.S.C. 154(b) by 932 days.

(21) Appl. No.: 11/658,363

(22) PCT Filed: Apr. 20, 2005

(86) PCT No.: PCT/EP2005/004238

§ 371 (c)(1),
(2), (4) Date: Feb. 13, 2007

(87) PCT Pub. No.: WO2006/010091

PCT Pub. Date: Feb. 2, 2006

(65) Prior Publication Data

US 2008/0289345 A1 Nov. 27, 2008

(30) Foreign Application Priority Data

Jul. 27, 2004 (DE) ..... 10 2004 036 301

(51) Int. Cl.
*F25B 1/00* (2006.01)

(52) U.S. Cl. ..... 62/228.1; 62/222

(58) Field of Classification Search ..... 62/117, 62/160, 222, 228.1, 498, 528
See application file for complete search history.

(56) References Cited

U.S. PATENT DOCUMENTS 4,258,553 A * 3/1981 Kelly et al. ..... 62/117
5,189,883 A * 3/1993 Bradford ..... 62/83
5,197,297 A 3/1993 Brendel et al.
5,685,163 A 11/1997 Fujita et al.
5,873,255 A 2/1999 Madigan
6,185,949 B1 2/2001 Madigan
6,295,821 B1 10/2001 Madigan
6,318,100 B1 11/2001 Brendel et al.
2003/0094007 A1 5/2003 Choi et al.
2003/0196445 A1 10/2003 Cho et al.
2004/0134206 A1 7/2004 Lee et al.

FOREIGN PATENT DOCUMENTS

CN 1125835 A 7/1996
CN 1517624 A 8/2004
EP 1146299 A 10/2001
FR 2679987 A 2/1993
JP 61175460 A 8/1986
JP 63290355 A 11/1988
JP 06341719 A 12/1994
JP 08-061815 A 3/1996

* cited by examiner

*Primary Examiner*—Melvin Jones
(74) *Attorney, Agent, or Firm*—Harness, Dickey & Pierce, P.L.C.

(57) ABSTRACT

The invention relates to a refrigeration machine, particularly a heat pump, comprising a closed circuit, which contains a coolant and in which an evaporator, a compressor, a condenser and an, in particular, electrically operated expansion valve are arranged one after the other. The refrigeration machine also comprises an overheating control unit for at least intermittently regulating the temperature of the coolant in the area of the compressor, particularly the compression final temperature. The invention also relates to a method for operating a refrigeration machine of the aforementioned type.

23 Claims, 3 Drawing Sheets

HEAT EXTRACTION MACHINE AND A METHOD OF OPERATING A HEAT EXTRACTION MACHINE

CROSS-REFERENCE TO RELATED APPLICATIONS

This application is a National Stage of International Application No. PCT/EP2005/004238, filed Apr. 20, 2005, and which claims the benefit of German Patent Application No. 10 2004 036 301.3, filed Jul. 27, 2004. The disclosures of the above applications are incorporated herein by reference.

FIELD

The invention relates to a heat extraction machine, in particular to a heat pump, comprising a closed circuit which has a refrigerant and in which an evaporator, a compressor, a condenser, and an expansion valve, in particular an electrically operated expansion valve, are arranged one after the other. The invention furthermore relates to a method of operating such a heat extraction machine.

BACKGROUND

The statements in this section merely provide background information related to the present disclosure and may not constitute prior art.

Heat extraction machines of the initially named kind are generally known. The refrigerant is evaporated and overheated in the evaporator, i.e. is heated above its saturation temperature. Overheating the refrigerant therefore means an increase in the refrigerant temperature beyond its saturation temperature at a constant pressure. The overheating is defined as the difference between the actual temperature of the refrigerant, e.g. in the region of the evaporator outlet, and the evaporation temperature or saturation temperature of the refrigerant.

Usually, in a conventional heat extraction machine, a predetermined value is preset for the overheating of the refrigerant and the overheating is regulated such that it does not substantially differ from the preset value—independently of other operating conditions—in order to achieve an optimum efficiency of the heat extraction machine, on the one hand, and to ensure a complete evaporation of the refrigerant, on the other hand. A typical value for the overheating amounts, for example, to 6 K up to 10 K.

In known heat pumps, it has proved to be a problem that the temperature of the evaporated refrigerant reaches such high values at the outlet of the compressor under specific operating conditions, for example at particularly low external temperatures, that a degradation of oil, e.g. lubricating oil, located in the compressor takes place and/or mechanical wear of the compressor is caused. This can result in damage to the compressor and require the switching off of the heat pump or of the compressor. In addition, at particularly low external temperatures, there is the risk of the evaporator icing up, which can likewise make it necessary to switch off the heat pump or to switch over a switch valve, in particular a four-way switch valve, arranged between the compressor and the condenser or evaporator for this purpose, for the deicing of the evaporator.

Both the switching off of the heat pump for the avoidance of an increased end compression temperature at the outlet of the compressor and the switching off of the heat pump or switching over of the switch valve for the deicing of the evaporator signify standstill times of the heat pump which impair the economy of the heat pump.

SUMMARY

It is therefore the underlying object of the invention to provide a heat extraction machine having improved economy and a method of operating such a heat extraction machine.

The method in accordance with the invention is in particular characterized in that the temperature of the refrigerant in the region of the compressor, in particular the end compression temperature, is regulated by means of an overheating regulating unit at least at times such that it does not exceed a critical upper temperature limit.

A temperature is understood as the critical upper temperature limit here at which there is a risk of damage to the compressor, e.g. by degradation of lubricating oil provided in the compressor and/or by mechanical wear of the compressor.

The refrigerant temperature in the region of the compressor, in particular the end compression temperature, can always be kept beneath the critical upper temperature limit by the regulation of the refrigerant temperature to a predetermined target temperature which is preferably selected to be a specific amount beneath the critical upper temperature limit to take account of an overshoot behavior of the refrigerant temperature. In this manner, damage to the compressor and a switching off of the heat extraction machine previously required for the protection of the compressor are effectively avoided. Standstill times of the heat extraction machine resulting from the switching off of the heat extraction machine or from damage to the compressor and the loss of the refrigerating capacity or heat output associated therewith are consequently minimized.

At the same time, the refrigerant temperature can be regulated by means of the overheating regulation unit such that it is as close as possible to the upper temperature limit that is as high as possible. An optimum heating output of a heat extraction machine working as a heat pump is thereby achieved. The overheating regulation unit satisfies a dual function in this process: it not only serves the regulation of the overheating to a predetermined value, but simultaneously also the regulation of the refrigerant temperature in the region of the compressor.

Both the minimized standstill times and the optimized heating output of the heat extraction machine result in increased total efficiency of the heat extraction machine considered over a year and thus in an improved economy of the heat extraction machine.

The regulation of the refrigerant temperature in the region of the compressor, in particular of the end compression temperature, does not have to take place permanently. It can, for example, be sufficient only to regulate the refrigerant temperature at particularly low external temperatures, e.g. during the winter months, since the risk is particularly high under these conditions that the end compression temperature reach values which result in damage to the compressor.

Advantageous embodiments of the invention are described in the dependent claims, in the description and in the drawing.

In accordance with an advantageous embodiment of the method in accordance with the invention, the ambient temperature of the heat extraction machine and in particular the external temperature is measured. If no permanent regulation, for example over the whole year, of the refrigerant temperature is provided, the regulation can be activated on the measurement of the ambient temperature or of the external temperature, when the ambient temperature or the external temperature falls below a predetermined lower temperature limit. The activation of the regulation of the refrigerant temperature therefore thus takes place dependent on the weather.

The refrigerant temperature is preferably measured downstream of the compressor and in particular in the region of the compressor outlet. It can be determined directly in this manner whether the refrigerant temperature at the compressor outlet, where the refrigerant temperature is the highest, exceeds the predetermined target temperature. If the refrigerant temperature exceeds this target temperature or if this case is threatening to occur, the refrigerant temperature can be regulated down accordingly by taking measures which will be explained in more detail further below. As soon as the refrigerant temperature is back in the range of the target temperature, the measures taken can be reversed again or stopped.

The refrigerant temperature is advantageously regulated by a change in the overheating of the refrigerant in the evaporator. An increase in the overheating of the refrigerant results in an increase in the refrigerant temperature in the region of the compressor, in particular in the end compression temperature, whereas vice versa a reduction in the overheating has the effect of a reduction in the refrigerant temperature. The overheating, in other words, is not regulated to a value which always remains constant, but the overheating value to be set is variable, with the variable regulation of the overheating in particular taking place in dependence on the weather.

The refrigerant temperature in the region of the compressor, in particular the end compression temperature, can be regulated within certain limits by a corresponding change in the overheating such that it always lies in the range of the predetermined target temperature. The overheating is in particular preferably controlled such that the refrigerant temperature in the region of the compressor outlet lies as close as possible to the critical upper temperature limit, but does not exceed it, to achieve an optimum heating output. The refrigerant temperature in the region of the compressor therefore forms the regulating parameter, whereas the overheating represents a variable and the expansion valve the corresponding actuator.

Furthermore, the risk of icing of the evaporator can be decreased by the reduction in the overheating. In this manner, the standstill times are shortened even further and the economy of the heat extraction machine is improved even further.

The overheating can be reduced when the refrigerant temperature, measured in particular in the region of the compressor, exceeds or threatens to exceed a predetermined target temperature. In this case, therefore, a direct monitoring of the refrigerant temperature, preferably at the compressor outlet, is used for the regulation of the refrigerant temperature.

Advantageously, the overheating is regulated in dependence on the ambient temperature of the heat extraction machine, in particular on the external temperature.

The overheating is determined, by the saturation pressure and/or by the saturation temperature of the refrigerant. A lowering of the saturation temperature or of the saturation pressure, e.g. due to a reduced external temperature, results in an increase in the overheating and thus to an increase in the refrigerant temperature in the compressor, whereas vice versa an increase in the saturation temperature or in the saturation pressure, e.g. due to an increase in the external temperature, results in a reduction in the overheating and thus in a reduction in the refrigerant temperature in the compressor. An increase or a decrease in the refrigerant temperature in the compressor can be countered by a corresponding regulation of the overheating while taking account of the ambient temperature or of the external temperature.

The overheating is preferably changed by a corresponding control of the expansion valve. An increase in the refrigerant flow through the expansion valve, i.e. through an opening of the expansion valve, results in a reduction of the overheating, whereas vice versa the closing of the expansion valve reduces the refrigerant flow and results in an increase in the overheating.

Alternatively or additionally to a reduction in the overheating, the refrigerant temperature can be reduced in the region of the compressor by a separate cooling of the refrigerant in the compressor. In this manner, the refrigerant temperature in the compressor itself can then be kept below the critical upper temperature limit when a reduction in the overheating is not sufficient for the reduction of the refrigerant temperature in the compressor or is not possible.

The compressor can be cooled by introducing liquid refrigerant into the compressor. The use of liquid refrigerant is particularly favorable since it has a lower temperature than the gaseous refrigerant compressed in the compressor.

Liquid refrigerant is preferably introduced into the compressed refrigerant, in particular in the outlet region of the compressor. The refrigerant is thereby directly cooled and the temperature of the compressor is thus indirectly reduced.

The liquid refrigerant is advantageously channeled of from the circuit downstream of the condenser and is guided to the compressor. After passing through the condenser, the refrigerant has a temperature at which the refrigerant is admittedly condensed, which is therefore lower than the end compression temperature, but which simultaneously lies above the temperature of the refrigerant at the compressor outlet. The liquid refrigerant can therefore be injected into the evaporated refrigerant without damaging the compressor.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
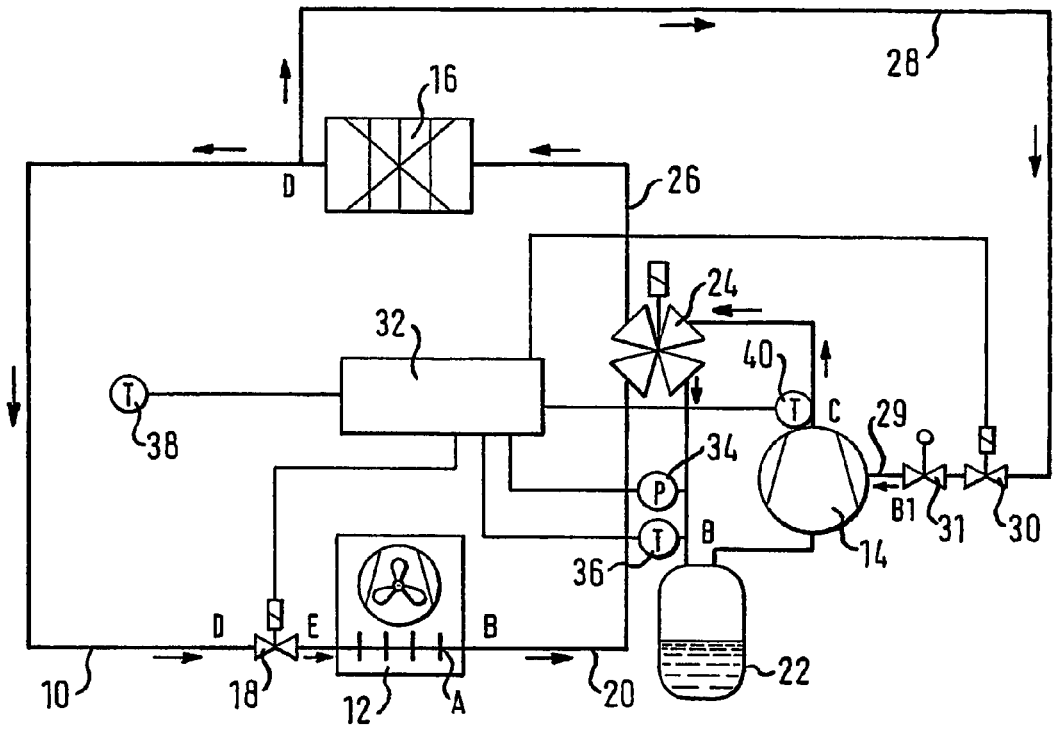
FIG. 1 is a schematic representation of a heat extraction machine in accordance with the invention.

The following description is merely exemplary in nature and is not intended to limit the present disclosure, application, or uses. It should be understood that throughout the drawings, corresponding reference numerals indicate like or corresponding parts and features.

The heat extraction machine in accordance with the invention shown in FIG. 1, which is described here in the function of a heat pump, comprises a closed circuit 10 having a refrigerant. An evaporator 12, a compressor 14, a condenser 16 and an electrically operated expansion valve are arranged one after the other in the refrigerant circuit 10.

The evaporator 12 and the compressor 14 are connected to one another by a suction gas line 20. Since the compressor 14 is configured for a compression only of evaporated refrigerant and would be damaged by an unintentional penetration of liquid refrigerant, a liquid separator 22 arranged in the suction gas line 20 is connected upstream of the compressor 14 and removes and collects liquid refrigerant not completely evaporated in the evaporator 12 and/or condensed in the suction gas line 20 from the refrigerant flow.

A four-way switch valve 24 arranged in the suction gas line 20 is connected upstream of the liquid separator 22 and is simultaneously arranged in a hot gas line 26 leading from the compressor 14 to the condenser 16. If—as is described here—the heat extraction machine is operated as a heat pump, i.e. in heating operation, the refrigerant flow heated in the compressor 14 can be switched over on a corresponding actuation of the switch valve 24 for the defrosting of the evaporator 12 and can be completely supplied to the evaporator 12. Alternatively, the switch valve 24 permits a switch over of the refrigerant flow such that the heat extraction machine can work in refrigeration operation.

Downstream from the condenser 16, a bypass line 28 branches off from the refrigerant circuit 10 and is connected to an injection line 29 connected to the compressor 14. The bypass line 28 and the injection line 29 permit the supply of liquid refrigerant to the compressor 14. A solenoid valve 30 arranged in the bypass line 28 is provided to control this refrigerant supply. A restrictor member 31, for example a nozzle or a capillary tube through which the refrigerant to be injected into the compressor 14 can be expanded and thereby additionally cooled can furthermore be arranged in the injection line 29.

The liquid refrigerant supplied to the compressor 14 through the bypass line 28 and the injection line 29 is injected into the compressed refrigerant in order to lower the temperature of the compressed refrigerant, in particular in the region of the compressor outlet, in this manner. The compressor 14 can thereby be protected from excessive temperatures which would damage the compressor 14.

Alternatively or additionally, it is also possible to circulate the liquid refrigerant supplied to the compressor 14 through cooling lines correspondingly provided in the compressor 14. This effects a cooling of the compressor 14 itself via which the compressed refrigerant is then also cooled.

The solenoid valve 30 is connected to and controllable by an overheating regulation unit 32. The overheating regulation unit 32 can be a separate unit or be integrated in a central heat pump control.

Furthermore, the overheating control unit 32 for the control of the expansion valve 18 is also connected thereto. The expansion valve 18 is an electrically operated expansion valve.

Furthermore a pressure transmitter or pressure sensor 34 connected to the overheating regulation unit 32 and a temperature sensor 36 connected to the overheating regulation unit 32 are arranged at the suction gas line 20 connected upstream of the liquid separator 22.

The evaporation pressure of the refrigerant evaporated in the evaporator can be measured by the pressure sensor 34. With knowledge of the thermodynamic and physical properties of the refrigerant, the saturation temperature of the refrigerant can be calculated from the measured evaporation pressure. The actual temperature of the overheated refrigerant flowing through the suction gas line 20 or the suction gas temperature is determined by the temperature sensor 36. The overheating regulation unit 32 determines the overheating of the refrigerant from the difference between the suction gas temperature and the saturation temperature.

Furthermore, a temperature sensor 38 is connected to the overheating regulation unit 32 for the measurement of the ambient temperature of the heat pump and in particular of the external temperature.

For the measurement of the temperature of the refrigerant compressed by the compressor 14, a temperature sensor 40 connected to the overheating regulation unit 32 is moreover provided in the region of the compressor outlet.

The cold process of the heat pump of FIG. 1 will be described in the following.

Figure 2:
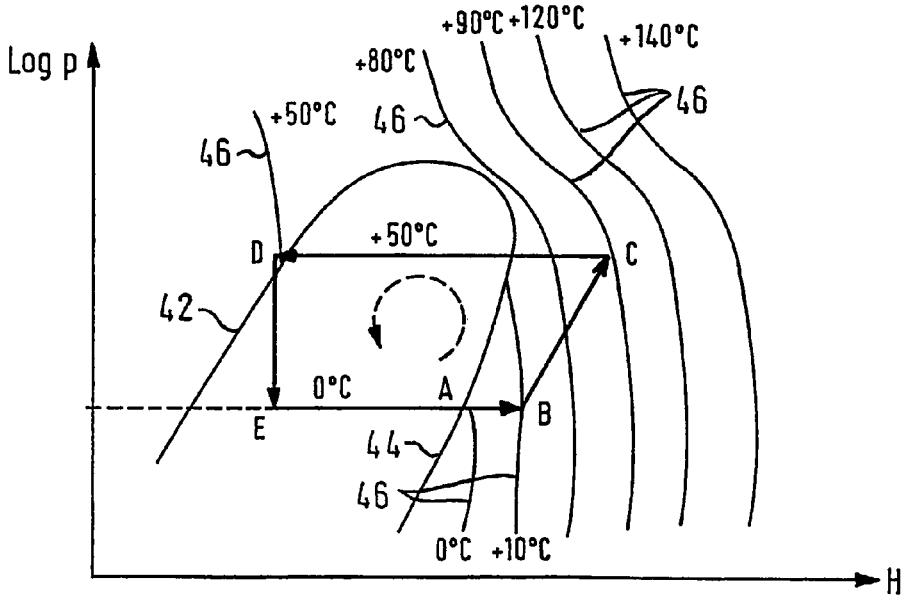
FIG. 2 illustrates a log p-H diagram of the refrigerant of the heat extraction machine of FIG. 1 and an associated cycle.

FIG. 2 shows a log p-H diagram of a refrigerant used in the heat pump of FIG. 1, where the pressure p of the refrigerant is entered logarithmically as a function of the enthalpy H. The limits of saturated liquid 42 and of saturated gas 44 are drawn as well as curves 46 of constant temperature.

The point E designates the state of the refrigerant after the expansion through the expansion valve 18. An evaporation E-A and overheating A-B of the refrigerant takes place in the evaporator 12.

The compressor 14 provides a compression B-C of the refrigerant which is accompanied by a corresponding temperature increase. In the embodiment shown, the temperature of the refrigerant is increased by the compressor 14 from +10° C. at the outlet of the evaporator 12 up to +90° C.

A condensing C-D of the refrigerant takes place in the condenser 16, with the condensing temperature amounting to +50° C. in the example shown. The now liquid refrigerant which is only 50° C. warm is subsequently expanded by the expansion valve 18 (D-E), with it cooling down to 0° C.

In the embodiment shown in FIG. 2, the overheating amounts to 10 K, that is just the difference between the temperatures at the point B (+10° C.) and at the point A (0° C.). The temperature at the point B corresponds to the actual temperature of the refrigerant in the suction gas line and is measured by the temperature sensor 36. The temperature at the point A, in contrast, corresponds to the evaporation temperature of the refrigerant which is determined from the evaporation pressure of the refrigerant measured by the pressure sensor 34.

Figure 3:
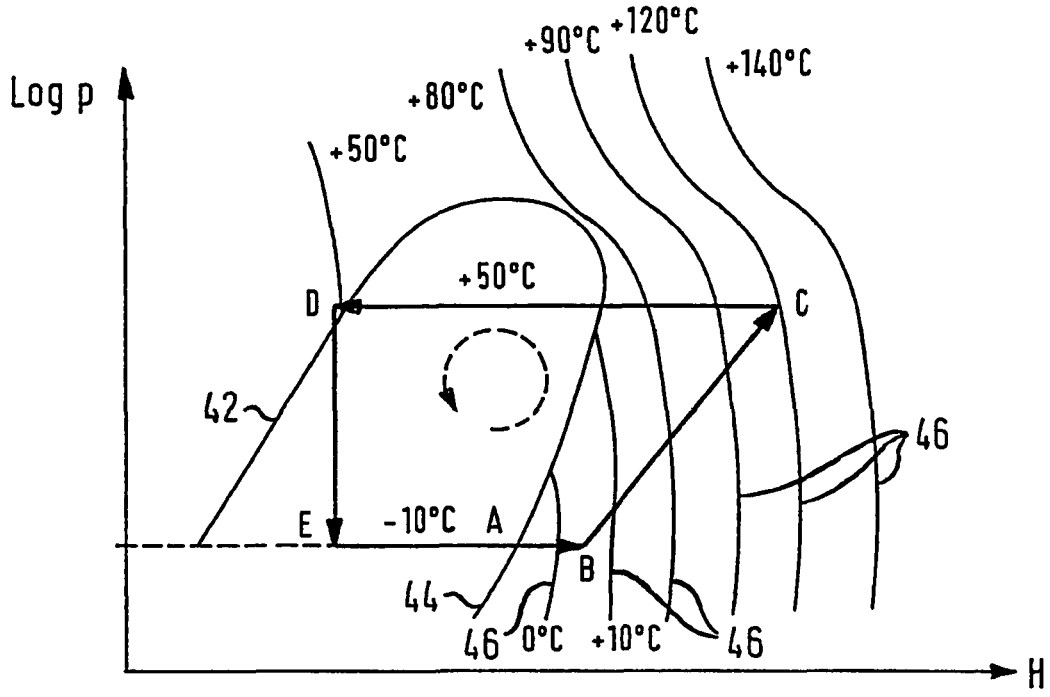
FIG. 3 illustrates the log p-H diagram of FIG. 2 at a reduced saturation temperature or a reduced saturation pressure of the refrigerant.

A situation is shown in FIG. 3 in which the evaporation temperature of the refrigerant is reduced by 10 K due to a reduced evaporation pressure in comparison with the situation shown in FIG. 2, i.e. it only amounts to −10° C. Such a reduction of the evaporation pressure can result, for example, from a lower external temperature. The reduced evaporation temperature of the refrigerant results in an increase in the overheating A-B which in turn effects an increase of the refrigerant temperature at the outlet of the compressor 14 (point C). In the embodiment shown, the increased refrigerant temperature at the compressor outlet amounts to +120° C.

Figure 4:
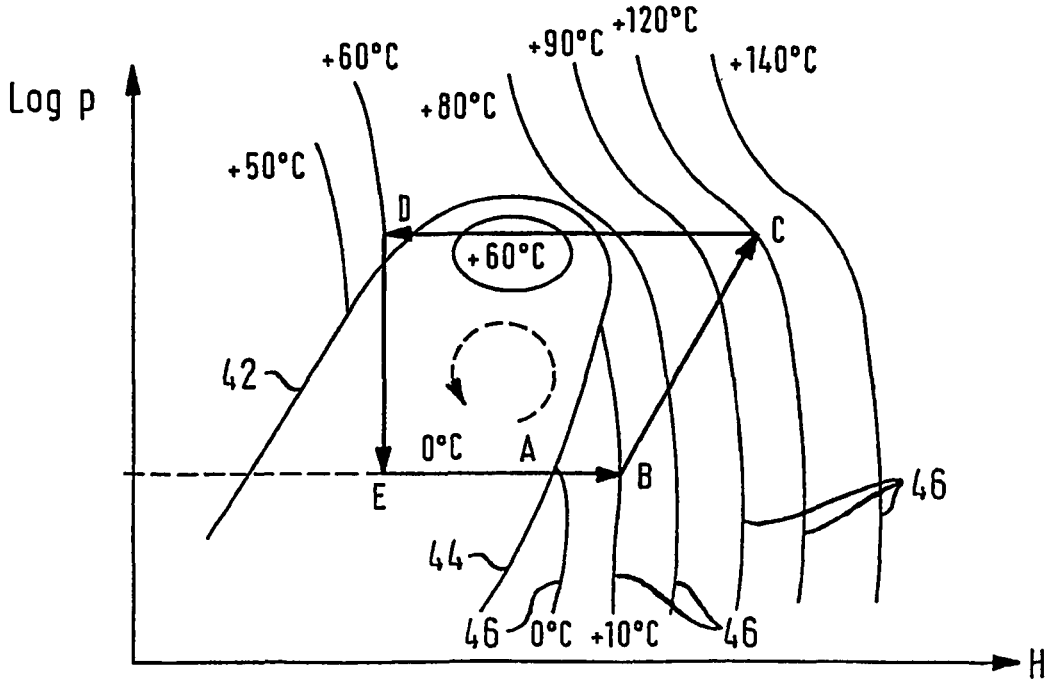
FIG. 4 illustrates the log p-H diagram of FIG. 2 at an increased condensing temperature of the refrigerant.

An increase in the condensing temperature at which the refrigerant is condensed in the condenser 16, C-D, also results in an increase in the refrigerant temperature at the compressor outlet C. As is shown by way of example in FIG. 4, an increase in the condensing temperature from 50° C. to 60° C. results in comparison with the situation shown in FIG. 2 with an evaporation temperature remaining the same of 0° C. in an increase of the refrigerant temperature from 90° C. to 120° C. at the compressor outlet C.

An increase in the refrigerant temperature at the compressor outlet proves to be problematic when the increased refrigerant temperature exceeds a critical upper temperature limit above which damage to the compressor 14 is to be expected, for example due to a degradation of lubricating oils provided in the compressor 14.

In accordance with the invention, a regulation of the refrigerant temperature at the compressor outlet by the overheating regulation unit 32 is provided such that the refrigerant temperature at the compressor output does not exceed the above-named critical upper temperature limit. For this purpose, the refrigerant temperature at the compressor outlet is regulated to a predetermined target temperature which lies somewhat below the critical upper temperature limit. In this process, the overheating A-B of the refrigerant which is variable by a change in the degree of opening of the expansion valve 18 and, alternatively or additionally, the injection of liquid refrigerant into the compressor 14, is provided as the variable.

Figure 5:
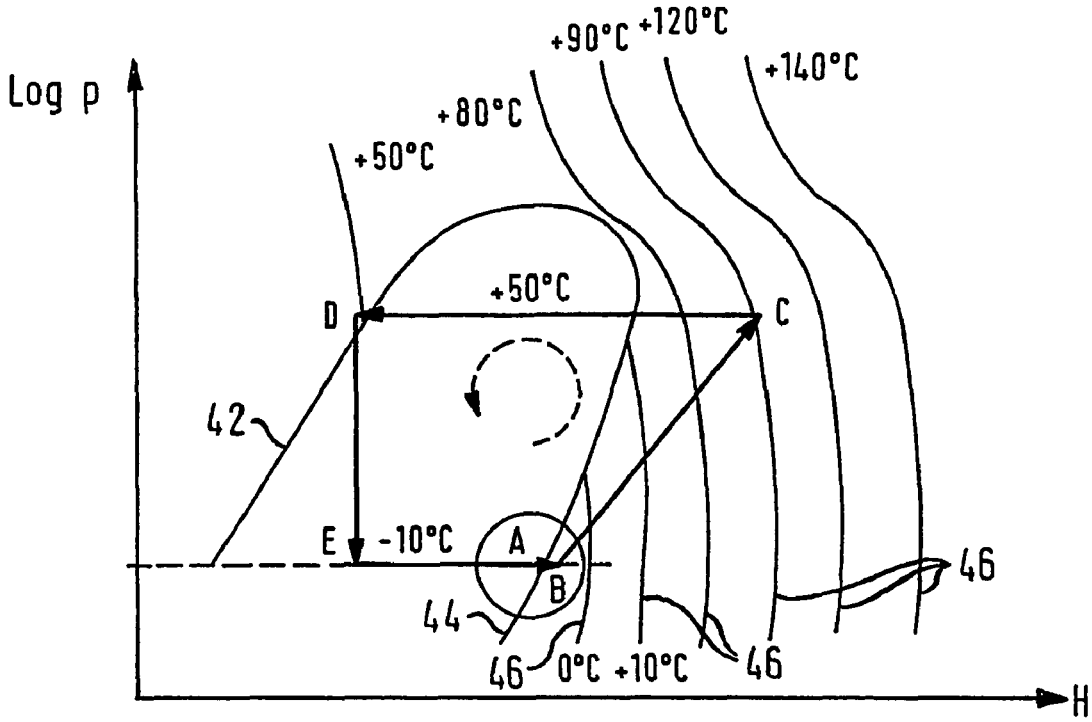
FIG. 5 illustrates the log p-H diagram of FIG. 3 at reduced overheating.

As can be seen from the diagram shown in FIG. 5, which starts from the situation shown in FIG. 3, i.e. from a reduced evaporation temperature of −10° C., the refrigerant temperature at the compressor outlet C can be reduced by a reduction in the overheating of the refrigerant. Vice versa, the refrigerant temperature at the compressor outlet C can be raised by an increase in the overheating.

The refrigerant temperature at the compressor outlet C or the end compression temperature can be regulated within specific limits by a corresponding adjustment of the overheating such that it adopts a maximum value, but just does not exceed the critical upper temperature limit. The heating output of the heat pump is thereby optimized and damage to the compressor or a switching off of the heat pump is avoided. Standstill times of the heat pump are consequently minimized. As a result, an improved economy of the heat pump is achieved.

The setting of the required overheating takes place by a corresponding control of the expansion valve 18 by the overheating regulation unit 32. An opening of the expansion valve 18, i.e. an increase in the refrigerant flow through the expansion valve 18, results in a reduction in the overheating, whereas a restriction of the expansion valve 18, i.e. a reduction in the refrigerant flow through the expansion valve 18, increases the overheating.

Figure 6:
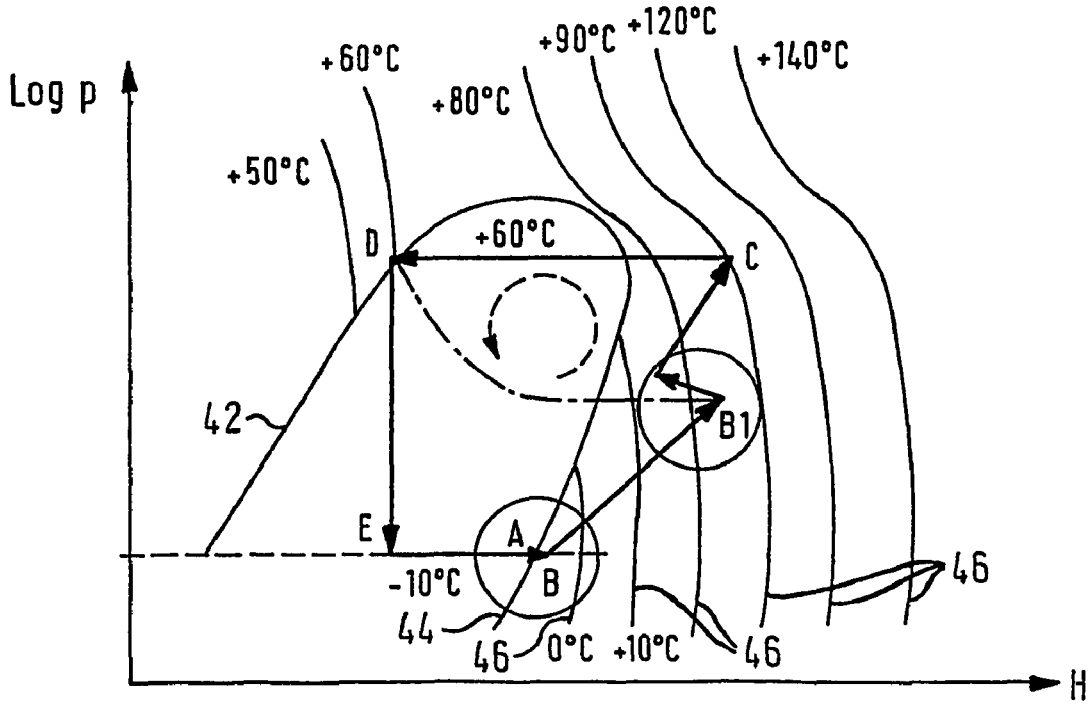
FIG. 6 illustrates the log p-H diagram of FIG. 3 at an increased condensing temperature, a reduced overheating and a supply of liquid refrigerant to the compressor.

If the reduction of the overheating of the refrigerant should not be sufficient for the reduction of the refrigerant temperature at the compressor outlet C, for example because, in addition to a reduced evaporation temperature of −10° C., an increased condensing temperature of +60° C. is also present, as is shown in FIG. 6, there is in addition the possibility in accordance with the invention to cool the refrigerant in the compressor 14, as was already described in connection with FIG. 1. The supply of liquid refrigerant to the compressor 14 at the point B1 effects a reduction in the enthalpy of the refrigerant, whereby the end compressor temperature at the compressor outlet C can be reduced from approximately 140° C. to 90° C.

The regulation of the refrigerant temperature at the compressor outlet is carried out as follows with the heat pump shown in FIG. 1:

During the operation of the heat pump, the overheating regulation unit 32 continuously monitors the external temperature via the temperature sensor 38. Furthermore, the overheating regulation unit 32 monitors the actual refrigerant temperature in the suction gas line 20 via the temperature sensor 36 and the evaporation pressure of the refrigerant in the suction gas line 20 via the pressure sensor 34. The overheating regulation unit 32 determines the currently present overheating of the refrigerant from the measured actual refrigerant temperature and the measured evaporation pressure of the refrigerant. Optionally, the overheating regulation unit 32 actuates the expansion valve 18 to maintain an overheating value recommended for the normal operation of the heat pump.

As soon as the external temperature falls below a predetermined value, the overheating regulation unit 32 starts to monitor the refrigerant temperature at the compressor outlet with the help of the temperature sensor 40. If the refrigerant temperature at the compressor output exceeds or threatens to exceed the predetermined target temperature disposed below the critical upper temperature limit, the overheating regulation unit 32 controls the expansion valve 18 such that the flow of the refrigerant through the expansion valve 18 is increased. The overheating is thereby reduced and, as a consequence, the refrigerant temperature at the compressor outlet is reduced to the target temperature. The expansion valve 18 is therefore opened further to reduce the refrigerant temperature at the compressor outlet.

If it is not possible to maintain the refrigerant temperature at the compressor outlet in the region of the predetermined target temperature by a reduction of the overheating, the overheating regulation unit 32 additionally activates the solenoid valve 30 to supply liquid refrigerant to the compressor 14 for the cooling of the compressed refrigerant. The actuation of the solenoid valve 30 takes place in dependence on the refrigerant temperature at the compressor outlet.

If the refrigerant temperature at the compressor outlet falls below the predetermined target temperature, for example, due to a cooling which has taken place, due to a falling of the condensing temperature and/or to an increased evaporation pressure of the refrigerant, the solenoid valve 30 is closed again by the overheating regulation unit 32 and the supply of liquid refrigerant to the compressor 14 is stopped.

If the refrigerant temperature falls even further at the compressor outlet, the overheating regulation unit 32 effects a reduction in the refrigerant flow through the expansion valve 18 by a corresponding control of the expansion valve 18 to again bring the overheating of the refrigerant to the original, recommended value.

The efficiency of the heat pump is increased during particularly cold external temperatures due to the regulation of the refrigerant temperature in accordance with the invention at the compressor outlet and the working range of the heat pump is extended to higher condensing temperatures and higher heat capacities. At the same time, the risk of damage to the compressor 14 by exceeding a critical upper temperature limit and the risk of icing of the evaporator 12 are reduced. Switching off phases an defrosting phases of the heat pump are thereby minimized. As a result, the variable regulation, and in particular the regulation of the overheating dependent on the weather, as well as the regulation of the refrigerant temperature at the compressor outlet, in particular of the end compression temperature, in accordance with the invention results in an improved economy of the heat pump.

The description is merely exemplary in nature and, thus, variations that do not depart from the gist of the present disclosure are intended to be within the scope of the invention. Such variations are not to be regarded as a departure from the spirit and scope of the present disclosure.

REFERENCE NUMERAL LIST

10 refrigerant circuit
12 evaporator
14 compressor
16 condenser
18 expansion valve
20 suction gas line
22 liquid separator
24 switch valve
26 hot gas line
28 bypass line
29 injection line
30 solenoid valve
31 restrictor member
32 overheating regulation unit
34 pressure sensor
36 temperature sensor
38 temperature sensor
40 temperature sensor
42 limit of saturated liquid
44 limit of saturated gas
46 curves of constant temperature

The invention claimed is:

1. A heat extraction machine, comprising:

a closed circuit having a refrigerant and in which an evaporator, a compressor, a condenser, and an expansion valve are arranged one after the other;

an overheating regulation unit for an at least timewise regulation of a temperature of the refrigerant in a region of the compressor such that the refrigerant temperature does not exceed a critical upper temperature limit; and a temperature sensor connected to the overheating regulation unit for measuring an external temperature of the heat extraction machine.

2. A heat extraction machine in accordance with claim 1, wherein a second temperature sensor connected to the overheating regulation unit is provided for measuring the refrigerant temperature downstream of the compressor.

3. A heat extraction machine in accordance with claim 2, wherein the second temperature sensor is arranged in the region of the compressor outlet.

4. A heat extraction machine in accordance with claim 1, wherein the expansion valve is controllable for weather-dependent control of the refrigerant by the overheating regulation unit.

5. A heat extraction machine in accordance with claim 1, wherein means are provided which permit an introduction of liquid refrigerant into the compressor.

6. A heat extraction machine in accordance with claim 5, wherein an injection line is connected to the compressor, through which the liquid refrigerant can be led into the compressor.

7. A heat extraction machine in accordance with claim 6, wherein a restrictor member is arranged in the injection line.

8. A heat extraction machine in accordance with claim 5, wherein the means comprises a solenoid valve controllable by the overheating regulation unit and arranged in a coolant line.

9. A heat extraction machine in accordance with claim 8, wherein one end of the coolant line is connected downstream of the condenser to the closed circuit and another end is connected to the injection line.

10. A heat extraction machine, comprising:

a closed circuit having a refrigerant and in which an evaporator, a compressor, a condenser, and an expansion valve are arranged one after the other; and an overheating regulation unit operable for regulation of a temperature of the refrigerant in a region of the compressor such that the refrigerant temperature does not exceed a critical upper temperature limit, and wherein the expansion valve is controllable by the overheating regulation unit for weather-dependent control of the refrigerant.

11. A heat extraction machine, comprising:

a closed circuit having a refrigerant and in which an evaporator, a compressor, a condenser, and an expansion valve are arranged one after the other;

an overheating regulation unit operable for regulation of a temperature of the refrigerant in a region of the compressor such that the refrigerant temperature does not exceed a critical upper temperature limit; and a mechanism for selectively introducing liquid refrigerant into the compressor which includes an injection line connected to the compressor through which the liquid refrigerant is supplied to the compressor and a restrictor member arranged in the injection line.

12. A heat extraction machine, comprising:

a closed circuit having a refrigerant and in which an evaporator, a compressor, a condenser, and an expansion valve are arranged one after the other;

an overheating regulation unit operable for regulating a temperature of the refrigerant in a region of the compressor such that the refrigerant temperature does not exceed a critical upper temperature limit; and a mechanism for selectively introducing liquid refrigerant into the compressor and including a coolant line connected to the compressor and a solenoid valve arranged in the coolant line and which is controllable by the overheating regulation unit.

13. A method of operating a heat extraction machine, comprising:

providing a closed circuit having a refrigerant and in which an evaporator, a compressor, a condenser and an expansion valve are arranged one after the other; and regulating a temperature of the refrigerant in a region of the compressor by means of an overheating regulation unit at least at times by a change in overheating of the refrigerant in the evaporator so that the refrigerant temperature does not exceed a critical upper temperature limit.

14. A method in accordance with claim 13, wherein an external temperature of the heat extraction machine is measured and taken into account in the regulation.

15. A method in accordance with claim 13, wherein the refrigerant temperature in the region of the compressor is measured for regulation of the refrigerant temperature.

16. A method in accordance with claim 13, wherein overheating is reduced when the refrigerant temperature measured in the region of the compressor exceeds a predetermined target temperature.

17. A method in accordance with claim 13, wherein overheating is regulated in dependence on an external temperature of the heat extraction machine.

18. A method in accordance with claim 13, wherein overheating is changed by a corresponding control of the expansion valve.

19. A method of operating a heat extraction machine, comprising:

providing a closed circuit having a refrigerant and in which an evaporator, a compressor, a condenser and an expansion valve are arranged one after the other; and regulating a temperature of the refrigerant in a region of the compressor by means of an overheating regulation unit at least at times so that the refrigerant temperature does not exceed a critical upper temperature limit, wherein the refrigerant temperature in the region of the compressor is reduced by a separate cooling of the refrigerant in the compressor.

20. A method in accordance with claim 19, wherein the refrigerant temperature in the region of the compressor is lowered by a cooling of the compressor.

21. A method in accordance with claim 20, wherein the compressor is cooled by introducing liquid refrigerant into the compressor.

22. A method in accordance with claim 19, wherein liquid refrigerant is introduced into the compressed coolant.

23. A method in accordance with claim 21, wherein the liquid refrigerant is branched off from the circuit downstream of the condenser and led to the compressor.

* * * * *